United States Patent [19]

Gerhard

[11] Patent Number: 4,521,941

[45] Date of Patent: Jun. 11, 1985

[54] CORNER FITTING FOR FREIGHT CONTAINERS

[75] Inventor: Helmut Gerhard, Weitefeld, Fed. Rep. of Germany

[73] Assignee: Westerwälder Eisenwerk Gerhard GmbH, Fed. Rep. of Germany

[21] Appl. No.: 333,556

[22] Filed: Dec. 22, 1981

[30] Foreign Application Priority Data

Dec. 23, 1980 [DE] Fed. Rep. of Germany ..... 3048718
Apr. 23, 1981 [DE] Fed. Rep. of Germany ..... 3116254

[51] Int. Cl.[3] ..... B65D 88/12; B65D 90/08

[52] U.S. Cl. ..... 24/287; 220/1.5; 220/23.4; 410/70; 410/71; 410/77; 410/82; 410/85

[58] Field of Search ..... 24/221 R, 287; 220/1.5, 220/23.4; 410/70, 71, 76, 77, 82, 83, 84, 85

[56] References Cited

U.S. PATENT DOCUMENTS 3,125,965 3/1964 De Penti et al. ..... 220/1.5
3,128,117 4/1964 Abolins ..... 220/1.5
3,966,075 6/1976 Schultz ..... 410/77
4,049,149 9/1977 Durenec ..... 24/287
4,325,488 4/1982 Ketner ..... 24/287

FOREIGN PATENT DOCUMENTS 1952581 4/1971 Fed. Rep. of Germany ..... 220/1.5

*Primary Examiner*—Gene Mancene
*Assistant Examiner*—David I. Tarnoff
*Attorney, Agent, or Firm*—Barnes & Thornburg

[57] ABSTRACT

A corner fitting is disclosed for freight containers, particularly for small and medium size containers. The corner fitting includes three mutually perpendicular side walls connected to one another to form a section of a corner of a cube having its apex pointing outwardly from a freight container when in an in-use position. Container handling openings are provided in at least one of the sidewalls and in an oblique triangular surface extending transverse to a diagonal through the corner apex. Particularly preferred embodiments of the corner fitting are formed from sheet metal blanks which are cut and bent along fold lines to form the sidewalls.

49 Claims, 16 Drawing Figures

FIG. 4
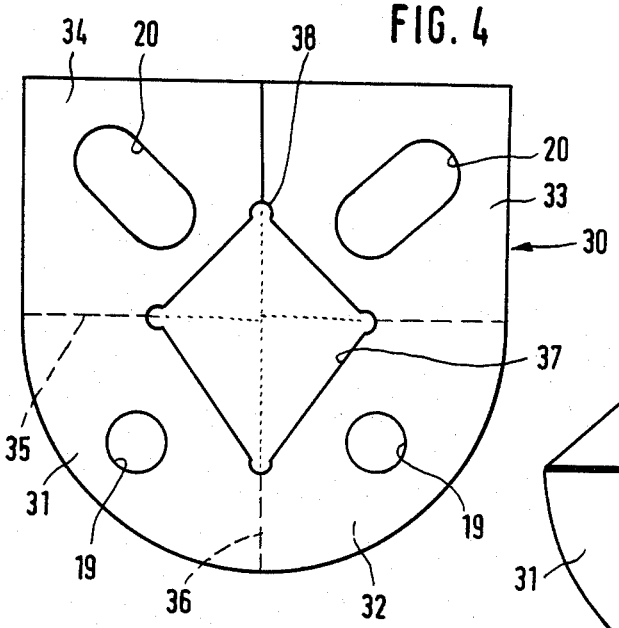
FIG. 5
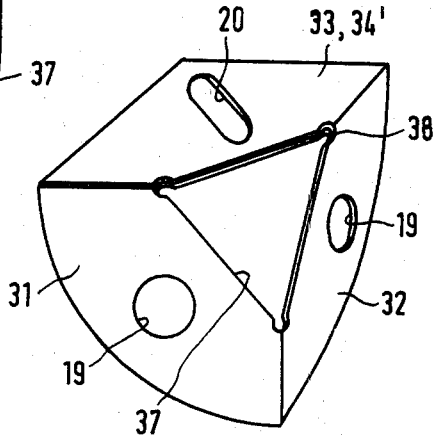
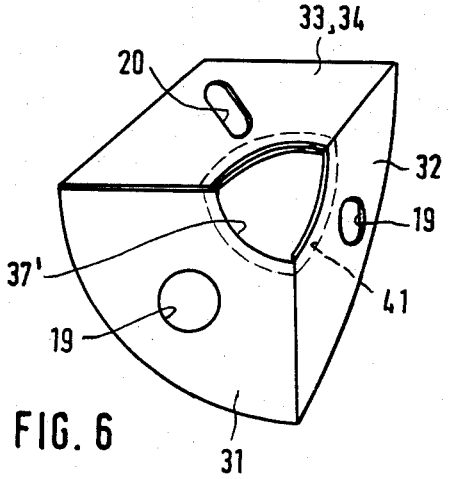
FIG. 6
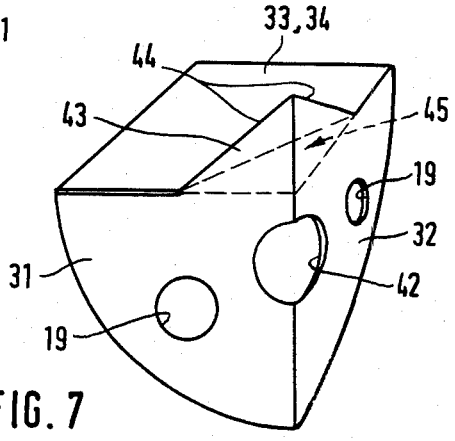
FIG. 7

FIG. 8
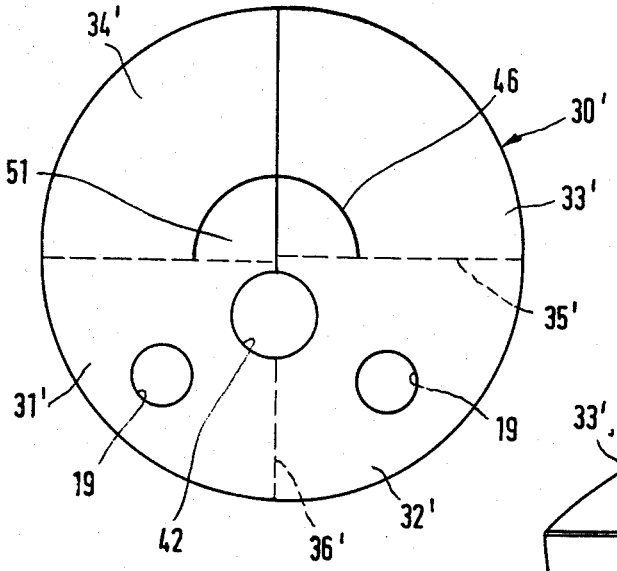
FIG. 9
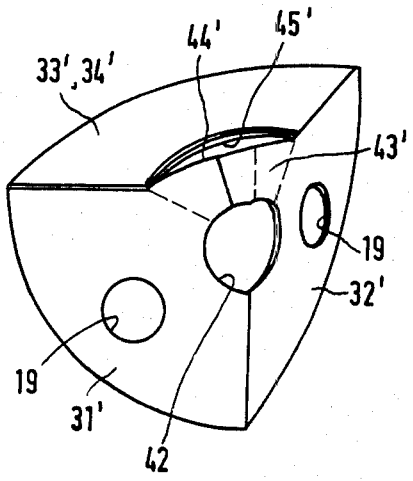
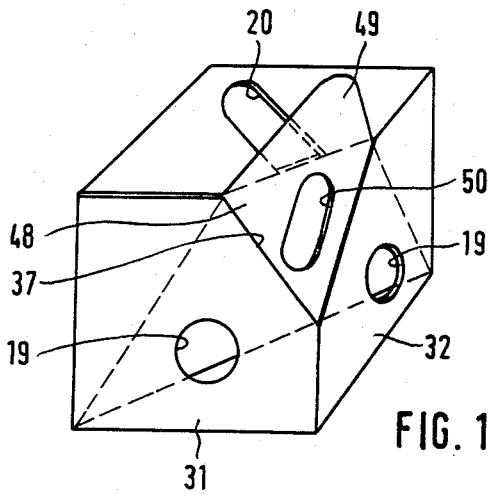
FIG. 10

FIG. 15
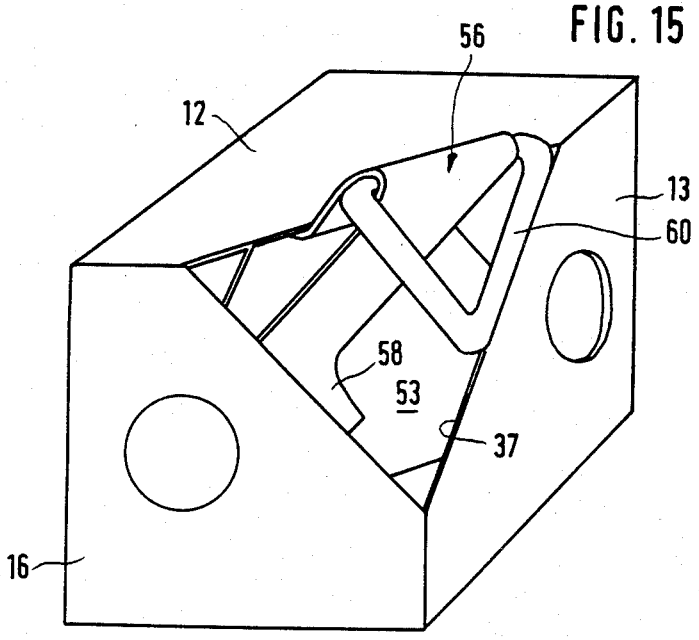
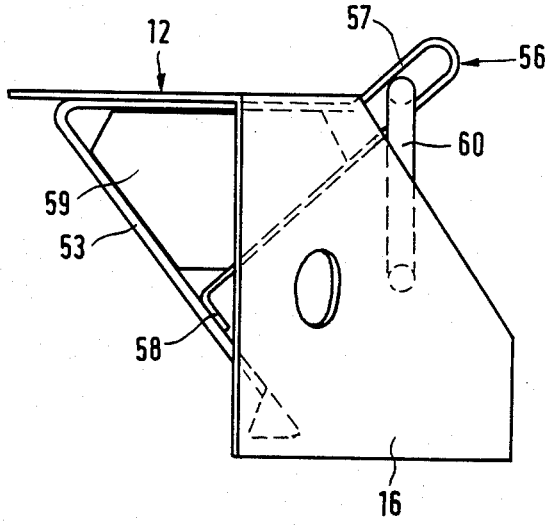
FIG. 16

CORNER FITTING FOR FREIGHT CONTAINERS

BACKGROUND OF THE INVENTION

The present invention relates to a corner fitting for freight containers, consisting of a parallelepipedal box having at least three walls defining the three outer faces of the fitting and extending perpendicularly to each other, at least one of these walls having an opening for inserting coupling or hoisting means.

The international standard ISO 1161 defines a corner fitting of this type for large containers having outer dimensions between 10 and 40 feet (approximately 3 to 12 m) of length, 8 feet (approximately 2.40 m) of width, and 8½ feet (approximately 2.60 m) of height. In accordance with these container dimensions and the loads exerted on such containers, the known, standardized corner fittings are formed as parallelepipedal box-shaped structural elements having dimensions of about 170 mm×160 mm×120 mm and are correspondingly heavy.

For smaller or medium-sized containers which are of lighter weight in view of the smaller loads to be transported, the known standardized corner fittings are too large and too heavy. Scale-down of the corner fittings is not possible as the openings provided in the upper or, respectively, lower wall and in the side walls for receiving the usual hoisting elements, such as crane hooks, and usual coupling elements would become too small.

A disadvantage of the known corner fittings further resides in the fact that four different corner fittings are required for the total of eight corners of a container because of the disposition of the known openings and in view of the different design of the upper and lower corner fittings.

It is an object of the present invention to devise a corner fitting for small and medium-sized containers which is so shaped that identical fittings may be used for at least the four upper corners and identical fittings for the four lower corners of a container. As a further object, the fitting of this invention should have high stiffness and rigidity at low weight and small dimensions. Furthermore, the corner fitting of the present invention should be designed so as to permit easy and direct lateral coupling between the facing corners of adjacent containers in order to interconnect a group of smaller containers to form a unit which may be handled as one piece.

SUMMARY OF THE INVENTION

The corner fitting for freight containers in accordance with the present invention comprises at least three walls defining a cube, at least one of the walls having an opening, wherein an outer pyramidal portion remote from the container is removed to form an oblique triangular surface confining the three walls and having a further opening. With this principal shape, identical corner fittings may be used for all eight container corners. The triangular surface interconnecting the three outer walls of the corner fitting increases the dimensional stability and facilitates the handling. The opening provided in this triangular surface permits access to the other opening provided in at least one of the three outer walls from the interior of the corner fitting so that a lateral coupling of adjacent containers is enabled without any intermediaries, such as by simple bolts and nuts.

In a preferred embodiment, the pyramidal portion removed is dimensioned such that a half to a quarter, preferably a third, of the full length of the cube edge is retained. As a result, the thus retained wall area is sufficiently large to locate the desired openings, while the triangular surface also has a sufficient size to permit easy access to the interior of the corner fitting. The latter fact is of essential significance in case four containers abutting at their corners are to be interconnected in two directions. For this purpose, each of the two lateral walls of the corner fitting preferably has a bore.

The opening formed in the triangular surface may have the shape of an inscribed circle or that of a hexagon leaving only the three corner regions of the triangular surface. As a further alternative, three bores may be provided adjacent the centers of the three sides of the triangular surface. In all these cases, the retained corner portions achieve the stiffening effect of the oblique surface.

In a further preferred embodiment, the outer wall forming the upper or, respectively, lower surface of the corner fitting is provided with an oblong hole having its longitudinal axis extending perpendicularly to the line of intersection between this wall and the triangular surface. In this embodiment, a comparatively large opening as required for inserting the usual coupling or hoisting element, such as a crane hook, can be located in the upper and lower wall surfaces in spite of the small overall dimensions of the corner fitting. A hook may be inserted either through the oblong hole in the upper wall or through the opening in the oblique surface, the tip of the hook extending out of the fitting through the respective other opening. When the corner fitting is used in this manner, it is particularly advantageous to reinforce the edge formed between the upper or lower wall and the triangular surface.

In another preferred embodiment, an inclined fin extends from the edge formed between the upper wall and the triangular surface which, in addition to reinforcing the edge, serves as a guide for an upper container stacked upon the present container. Instead of such fin, a bracket for engagement by a hook may be attached to the edge formed between the upper or lower wall and the triangular surface. In a fitting intended for use at an upper container corner, the bracket preferably extends in a plane perpendicular to the upper wall of the fitting. In a fitting intended for use with a lower container corner, the bracket preferably lies in a plane parallel to the lower wall of the fitting. By this means, stacking of the containers is not impeded. A further, universal hook-engaging means consists of a Y-shaped bracket having its three ends connected to the corners of the triangular surface. Such Y-shaped bracket results in an excellent reinforcement of the corner fitting in the regions of the oblique surface, at the same time permitting identical fittings to be used for all eight container corners.

The corner fitting of this invention may be realized as a casting or from a sheet metal blank bent and welded at certain edges of the fitting. In the latter case, the three triangular portions of the blank corresponding to the pyramid may be welded upon each other in an overlapping manner to form a reinforced triangular surface, or they may be folded inwardly and overlap-welded with the outer walls to reinforce portions of these walls. Preferably, bores in these outer walls are disposed in such reinforced portions. In another advantageous embodiment, the lug extending from the corner formed between the upper wall and the triangular surface may be formed by one of the triangular portions of the blank corresponding to the removed pyramid of the corner fitting.

In another preferred embodiment of the present invention, the corner fitting is formed from a plane blank which is rectangularly bent along a first substantially straight line and is also rectangularly bent along a second straight line perpendicularly intersecting the first line on one half of the second line from the intersection with the first line and cut in the other half, the two quarter surfaces separated by the cut being connected with each other in superimposed relationship. The two superimposed quarter surfaces of the blank advantageously form the upper surface of a corner fitting disposed at an upper container corner or the lower surface of a lower corner fitting. In the first case, the double thickness of the upper wall is of significance because this surface serves to support other containers stacked thereon and to receive crane hooks, coupling or lashing elements. In the second case, the double thickness of the lower wall is of significance in view of the strength of this wall serving as a supporting surface of the container. Provided a blank of sufficient thickness is used, the remaining three surfaces of the corner fitting facing the container, as are present in the corner fittings for large containers in accordance with the international standard ISO 1161, may be omitted.

The blank may have the shape of a circle or of a half-circle with a half-square connected thereto. In these embodiments, material and weight are saved even though the strength in the areas exposed to load, particularly in the edge areas of the corner fitting, is not reduced. Moreover, in a series production of corner fittings from large sheets of metal, the individual blanks may be mutually offset so that there is particularly little waste.

In another preferred embodiment, the opening in the oblique surface may be circular in which case it may be formed by a simple punching or other hole forming process. In the finished fitting, a triangular opening having curved edges is obtained which reduces the cutting effect of the edge and results in an advantageous distribution of forces in centering stacked containers, hoisting and lashing. For similar reasons, in case of a triangular opening having straight edges, the corners of such opening are rounded.

In further preferred embodiments, the opening of the fitting is formed by providing the blank with a cut either in the form of a semicircle symmetrical with respect to the second line or in the form of two straight lines forming an angle to each other and extending symmetrical to the second line, so that a beak-like projection is produced which assists in guiding and centering containers stacked upon each other and in locking the upper container by engaging the recessed corner portions of the respective lower corner fittings of the upper container. Preferably, the web-portions of the blank forming the beak-like projection is formed to have double wall thickness to give the projection increased strength in that region in which it may be used for engagement by a crane hook.

In a further particularly preferred embodiment, the three walls extending perpendicularly with respect to each other and forming the outer surfaces of the corner fitting are connected by a substantially triangular junction plate which extends in a space-diagonal plane of the cubic corner fitting which is substantially parallel to the triangular surface. The three corners of the junction plate are connected to the corners of the three outer walls of the fitting diagonally opposite to the removed outer corner of the fitting. In this embodiment, the junction plate forms the only rear wall of the fitting facing the container while at the same time leaving the areas of the three outer edges of the corner fitting free. The following essential advantages result from this concept:

(a) The junction plate extending in the space-diagonal plane of the cubic corner fitting provides higher dimensional stability in all three coordinate directions than the three mutually perpendicular walls facing the container and completing the parallelepiped as known with the ISO corner fittings.

(b) At the same time, the single rear wall formed by the junction plate requires less material so that the corner fitting has reduced weight in spite of increased rigidity.

(c) The profile elements of the container frame may be inserted to a greater or smaller extent into the edge regions of the corner fitting left free by the triangular junction plate and welded to these edge regions in an overlapping manner. The exact length of the profile elements of the container frame thus become uncritical, and the desired overall dimensions of the container are maintained with high accuracy due to the overlapping welding of the corner fittings.

(d) the inner surface of the junction plate is available for mounting fixation or engagement elements which are accessable through the opening in the triangular surface.

(e) These elements mounted on the junction plate for handling by crane or lashing have a small cantilevered length.

In a preferred embodiment, the tips of the junction plate may be bent in the direction of the outer container corner or in the opposite direction and welded to the corner regions of the three walls in overlapping fashion. Alternatively, the corners of the three walls of the fitting diagonally opposite to the outer corner of the fitting may be bent inwardly and welded to the junction plate in overlapping fashion, the tips of the junction plate being cut-off.

Further preferred embodiments of the invention provide for a manufacture of the fitting from one blank in which each of the three fitting walls are formed integrally to a tip of the junction plate or in which the three walls are interconnected by two of the outer edges of the fitting and the junction plate is formed integrally with a tip of one of the walls. In the first case, all three outer edges of the fitting must be welded, and these welds may be performed simultaneously with the overlapping welding of the inserted container frame elements. In the second case, only one weld is required at one outer edge of the fitting, whereas two further connections may consist in overlapping welds between the two free tips of the junction plate and the corresponding corners of the fitting walls.

In further advantageous embodiments of the present invention, an engagement element for inserting hoisting, lashing and/or coupling elements is provided at the surface of the junction plate facing the outer corner of the fitting, the engagement element including a bracket having one end welded to this surface of the junction plate and its other end connected to a tip thereof. The junction plate and the bracket may be formed from a one-piece-blank by corresponding bends. The arm of the bracket formed at one tip of the junction plate may have a portion of its length welded to the inner surface of the respective fitting wall, thereby increasing the stiffness of the fitting. Furthermore, the same bracket may extend through the opening in the triangular surface and from an abutment surface inclined upwardly and outwardly with respect to the upper fitting wall. The bracket thus serves as a centering element when stacking several containers upon each other provided this bracket is formed as at all four upper corner fittings of a container. In addition, a ring may engage the bracket which is so shaped that it fits through the opening in the triangular surface. Such ring may serve for engagement by a crane hook and may, for this purpose, move out of the corner fitting to facilitate engagement by the crane hook; on the other hand, it will be received by the interior of the fitting when not in use, so that it does not interfere. Further stiffness of the junction plate is achieved by inserting a reinforcing web between the two arms of the bracket.

In a further preferred embodiment, the engagement elements may include a hook with a helical eye in which a rope loop or a ring may be inserted. In this case, the hook with the helical eye will not extend from the corner fitting.

In accordance with a further preferred embodiment of the invention, the junction plate may be dimensioned relatively to the edge elements of the container frame in such a way that these elements may be welded to the edge of the junction plate in addition to being welded in the edge region of the fitting.

If necessary, the frame elements may have corresponding cut-outs at their inner edges. Such an additional welding results in a further stiffening of the corner fitting.

BRIEF DESCRIPTION OF THE DRAWINGS

Preferred embodiments of the invention will now be described with reference to the drawings, in which

FIG. 4 is a blank for a corner fitting for freight containers;

FIG. 5 shows the fitting manufactured from the blank shown in FIG. 4;

FIGS. 6 and 7 represent modifications of the corner fitting according to FIG. 5 as manufactured from blanks modified with respect to that shown in FIG. 4;

FIG. 8 shows a further blank for a corner fitting;

FIG. 9 represents the corner fitting manufactured from the blank of FIG. 8;

FIG. 10 shows a further corner fitting having an interior reinforcing wall;

FIGS. 15 and 16 are respectively a perspective view and a side view of another preferred embodiment of a corner fitting.

DETAILED DESCRIPTION OF PREFERRED EMBODIMENTS

Figure 1:
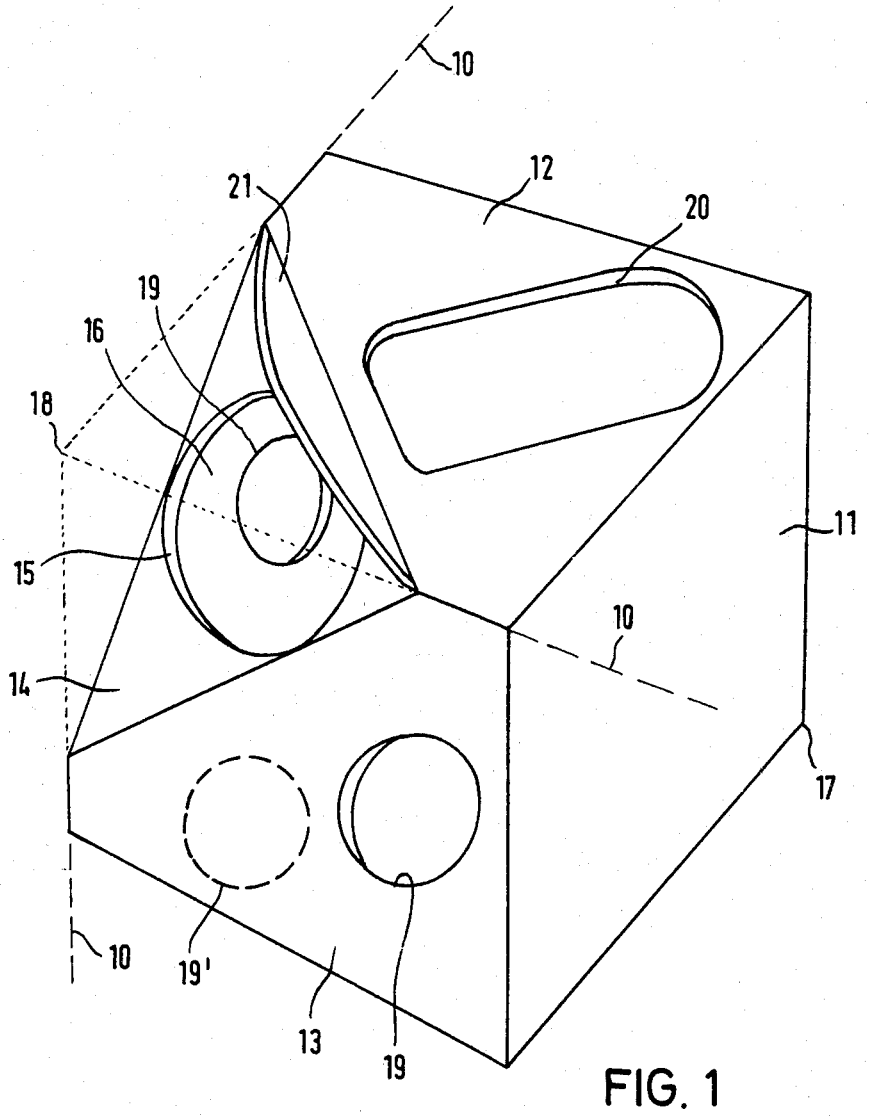
FIG. 1 is a perspective representation of a corner fitting for small containers according to a first embodiment.

In the representation of FIG. 1, the phantom lines 10 indicate an upper corner region of a container (not further represented) into which a corner fitting is inserted. Of this corner fitting, FIG. 1 shows an inner surface 11, facing the container, the upper wall 12, a lateral wall 13, and an oblique surface 14. A portion of the second lateral wall 16 is seen through an opening 15 provided in the oblique surface 14.

The surface 14 has the shape of an equilateral triangle, thus extending perpendicular to that space diagonal which connects the corner 17 of the cubic fitting facing the interior of the container to the opposite corner 18 which forms the apex of the removed prism. The lines at which the obliue surface 14 intersects with the lateral walls 13 and 16 and with the upper wall 12 thus extend at an angle of 45° with respect to the cube edges. In the representation of FIG. 1, these lines of intersection are placed so that about one third of the length of the cube edges is retained.

Figure 2:
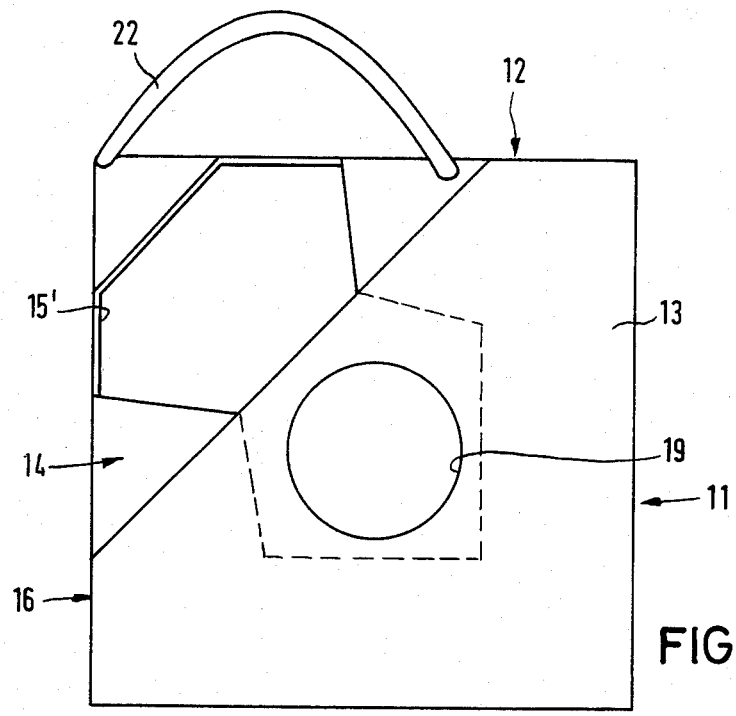
FIGS. 2 and 3 are side views of corner fittings in modifications.
Figure 3:
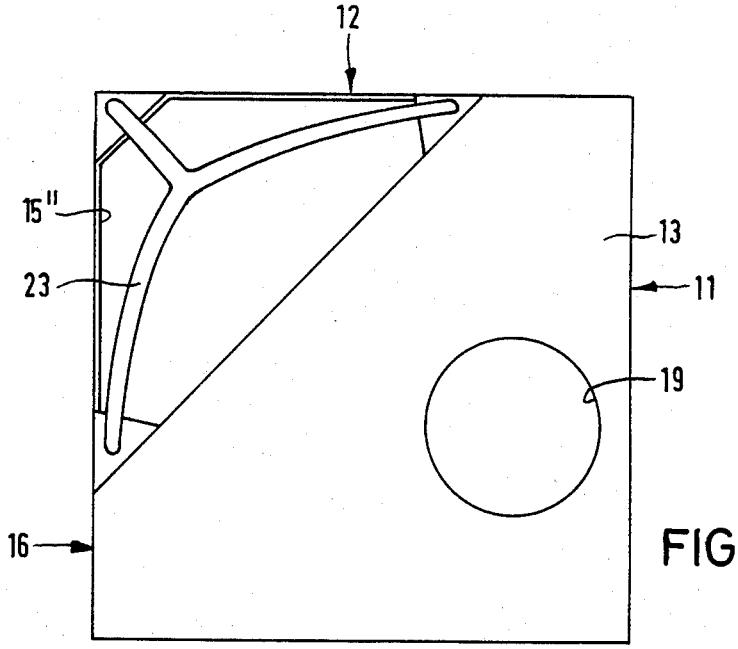

The opening 15 provided in the oblique surface 14 has in FIG. 1 the shape of a circle inscribed into the triangle of the oblique surface. In accordance with FIGS. 2 and 3, the opening 15', 15'' has the shape of a hexagon. FIG. 2 shows a regular hexagon of which every second side coincides with the triangle of the oblique surface 14, so that only the corner regions of the triangular surface are retained. In FIG. 3, the hexagonal opening 15'' covers almost the entire triangular surface. Bores 19 provided in the lateral walls 13, 16 serve for the mutual lateral coupling of adjacent containers. Since these bores 19 are accessible from their inner side through the opening 15 in the surface 14, direct coupling such as by bolts and nuts is enabled. The oblique surface further allows the mutual coupling of four containers abutting in one plane, thereby forming larger handling units which is of significance particularly in the case of small containers for which the present fitting is intended. For static reasons, the bores 19 in the sidewalls 13 are disposed close to an inner wall 11 of the fitting facing the container. Thus, the bore is located at the position shown in FIG. 1 in solid lines or as that shown in broken lines. It is furthermore possible to provide one bore 19 and 19' at each of the two locations.

The upper wall 12 of the container fitting has an oblong hole 20 the longitudinal axis of which extends diagonally and perpendicularly to the oblique edge of the upper wall 12 defined by the oblique surface 14. The hole 20 is dimensioned so that usual coupling or hoisting elements, such as crane hooks, may be inserted. A crane hook may be inserted into the oblong hole 20 in such a manner that the tip of the hook extends through the opening 15 provided in the surface 14. This type of inserting the hook is of advantage in case the pull originates from a point above the center of the container. Accordingly, when the pull is released, the hook does not disengage. On the other hand, when the pulling direction is vertical, horizontal or in an upwardly and outwardly inclined direction, it is preferred to insert the hook through the opening 15 and allow its tip to leave through the oblong hole 20, again insuring that the hook by its own weight is rotated further into its anchoring position when the pull is released, such rotation being aided by the oblique surface 14. The oblong hole 20 may further be used in coupling containers packed upon each other by means of locking elements.

According to FIG. 1, the oblique edge formed between the surface 14 and the upper wall 12 of the container fitting is reinforced by an upwardly and outwardly inclined fin 21 which is shaped approximately like a segment of a circle. This fin 21 furthermore has the function of an adjusting and abutting element in the stacking of containers wherein the oblique edge provided at the lower corner fitting of an upper container is guided into the proper position by the fin 21. The fin 21 is provided only at fittings intended for use at upper container corners, while it is absent from lower corner fittings. Accordingly, upper corner fittings are different from lower corner fittings in this embodiment; because of the cubic form, however, identical corner fittings may be used for all four upper container corners, and identical fittings may be used for all four lower container corners.

Rather than extending outwardly, as shown in FIG. 1, a reinforcing fin extending into the interior of the fitting may be attached to the edge. In this case, identical fittings may be used for all eight corners of a container.

In the embodiment shown in FIG. 2, an arc-shaped bracket 22 is provided at the location of the fin 21 of FIG. 1, which bracket 22 is welded to the triangular portion of the oblique surface 14 left outside the opening 15'. This bracket 22 may serve for engagement of hooks or other pulling elements so that, in this case, an oblong hole 20 such as shown in FIG. 1 is not required in the upper wall. For interlocking stacked containers in the vertical direction, a circular bore similar to those provided in the lateral walls would be sufficient, unless special turnbuckles are employed. Similar to the fin 21 shown in FIG. 1, the bracket 22 may extend in an upwardly and outwardly inclined direction for providing a centering function in stacking containers and additionally effecting a certain stiffening of the oblique edge.

Alternatively, as shown in FIG. 2, the bracket 22 may stand vertically upwardly so as to extend into the opening 15' provided in the corner fitting of a stacked upper container. On the other hand, if the bracket 22 is provided at a lower fitting, it extends horizontally and may thus serve for fixing and latching the container to a support. When two containers are stacked upon each other, the upright bracket provided at the upper fitting of the lower container extends through the horizontal bracket provided at the upper container.

In the embodiment of FIG. 3, a Y-shaped bracket 23 is shown which has its three ends welded to the corner region of the oblique surface retained outside the opening 15". This bracket 23 again effects a reinforcement of the oblique edge and serves for engagement by pulling elements. Since it does not exceed the profile of the cube in any direction, the corner fitting shown in FIG. 3 is suited for all eight container corners.

The corner fitting may be formed in any conventional manner as a casting, in which case the fin 21 shown in FIG. 1 may be integrally formed or welded to the fitting. In this case, the borders of the holes 15, 19 and 20 will have reinforced cross sections. On the other hand, it is possible to form the corner fittings by bending a blank of sheet metal and to connect the abutting edges by welding. In this case, the fin 21 shown in FIG. 1 may be formed from that triangular portion of the upper wall 12 which is left over as a consequence of the missing pyramid. The other two remaining triangular portions may be welded upon each other to achieve a reinforcement of the opening 15 in the oblique surface 14, or may be folded inwardly to reinforce the other two oblique edges of the side walls 13 and 16. This latter case is shown in FIG. 2 in phantom lines. In this case, it is advantageous to provide the bore 19 in the area of the side wall 13 which is reinforced by the folded section of sheet metal.

As indicated in FIG. 1, the inner surfaces of the container fitting 11 facing the container may be formed as closed walls which can be connected to the container by means of welding or in any other desired manner. Alternatively, the walls 11 may be omitted more or less completely, and the fitting may be connected to L-beams forming the container edges in such a manner that the fitting is inserted into such L-beams or is disposed on the outside of the container edges. In the first case, the outer walls of the container fitting are offset inwardly with respect to the container walls, which results in a spacing between the fittings of adjacent or superimposed containers. Such spacing may be used for intermediate elements of turnbuckles or for fastening tightly abutting containers by means of wedges.

For coupling adjacent containers, cables, bands, chains or similar connecting elements, which are fed through the holes of the corner fittings and tensioned, may be used instead of the above-mentioned turnbuckles, bolts and nuts.

In FIG. 4, a blank 30 for a corner fitting is shown which comprises four quarters 31, 32, 33, and 34, of which the sections 31 and 32 have the form of quarters of a circle and the sections 33 and 34 are in the form of squares having an edge length equal to the radius of the circle. The four quarters 31 to 34 adjoin each other along two perpendicularly intersecting substantially straight lines 35 and 36.

A diamond-shaped opening 37 is punched in the center of the blank 30, which opening is symmetrical to the line 36 and has its axes coinciding with the lines 35 and 36. The confining edges of the opening 37 lying in the quarters 33 and 34 extend at angles of 45° with respect to the lines 35 and 36. Similarly, the two other edges of the opening 37 may extend at 45° with respect to the lines 35 and 36, thus resulting in a square opening. The corners of the opening 37 are rounded outwardly, as shown at 38, or inwardly to remove peak stresses. A bore 19 is formed in each of the quarters 31 and 32, and an oblong hole 22 is formed in the quarters 33 and 34, the longitudinal axis of the oblong hole 20 extending at 45° through the intersection between the two lines 35 and 36.

For forming the corner fitting shown in FIG. 5, the blank of FIG. 4 is cut in the upper portion in the line 36 as shown by the solid line and bent about 90° in the lower portion of the line 36 as well as along the lines 35, all bends being made in the same direction. In doing so, the two quarters 33 and 34 are superimposed and sufficiently welded together. As indicated in FIG. 4, the bending line 35 is offset in the area of the intersection with the line 36 by the thickness of the blank material to ensure a proper cubic shape of the finished corner fitting.

In the fitting shown in FIG. 5, the double wall 33, 34 forms the upper surface of a fitting for an upper container corner or the lower wall for a lower container corner. The oblong hole 20 serves for engagement by a crane hook, the tip of which can extend through the opening 37, or vice versa. The double wall thickness effects sufficient strength in hoisting operations by means of a crane hook inserted as described above. Due to the square starting shape of the wall 33, 34, the oblong hole 20 may easily be placed in this wall. The bores 19 provided in the lateral walls 31, 32 of the fittings serve for the lateral coupling of laterally adjacent containers, and these bores 19 can be located in the quadrant-shaped starting area of the blank, which is otherwise of advantage due to the saving in material and weight, taking into consideration that the corner region of the wall disposed outside the circular arc (if a quadratic starting form is assumed) is of little significance for the strength of the fitting.

The corner fitting shown in FIG. 5 is mounted to a container by placing the edge elements of the container into or on the edge regions of the fitting and welding.

The corner fitting shown in FIG. 6 is formed from a blank which differs from the blank 30 shown in FIG. 4 only in that it has a circular opening concentric to the intersection of the two lines 35 and 36 instead of the diamond-shaped opening 37. In the finished fitting shown in FIG. 6, this results in a substantially triangular opening 37' having curved sides.

As shown in FIG. 6, the border region of the opening 37' is reinforced by internally welded anular elements 41. Similar (straight) reinforcing elements including or excluding engagement means for fast-lashing may be provided with the triangular opening 37 in the corner fitting of FIG. 5, if desired.

For producing the corner fitting shown in FIG. 7, a blank is used which differs from the blank 30 of FIG. 4 in that only the upper two cuts of the cut-out 37 lying in the quarters 33 and 34 are performed, and that a hole 42 disposed in the two lower quarters 31 and 34 symmetrically to the line 36 is provided. In addition, the oblong holes 20 may be omitted. According to FIG. 7, a beak-shaped projection 43 is formed in the upper extension of the vertical edge above the hole 42, the oblique upper edges 44 of the projection 43 serving for guiding and centering the lower corner fitting of a container stacked upon the present container. In the stacked condition, the projection 43 extends into the corresponding opening (37) provided at the lower fitting of the upper container. The opening 45 formed behind the projection 43 cooperates with the hole 42 for engaging a crane hook.

The corner fitting shown in FIG. 9 distinguishes from that of FIG. 7 essentially in that it is formed from a circular blank shown in FIG. 8 and that the projection 43' and the opening 45' are formed by a semicircular cut made in the blank of FIG. 8. Moreover, the web 51 existing between the cut 46 and the hole 42 is separated by a cut 47 extending along the line 36', and the two portions thus formed are welded in a partly overlapping manner as shown in FIG. 9. A somewhat inwardly inclined projection 43' is thus obtained which has a double wall thickness in that portion in which it is most exposed to the load and wear by the crane hook. Similar to the corner fitting of FIG. 7, the curved edge 44' of the projection 43 in the corner fitting of FIG. 9 serves for guiding, centering and locking of containers stacked upon each other.

The corner fitting shown in FIG. 10 is formed from a blank which differs from that of FIG. 4 in that the two lower quarters 31 and 32 are also square. A triangular reinforcing wall 48 is inserted into the corner fitting of FIG. 10, the lower edge of the wall 48 forming the plane diagonal of the (non-existing) lower fitting wall, an upper tongue 49 of the wall 48 extending through the opening 37. The reinforcing wall 48 has its edges disposed inside the fitting welded to the side walls 31 and 32 of the fitting and its rear surface welded at the upper edge of the opening 37 shown in phantom lines in FIG. 10. Furthermore, the tongue 49 may be bent with respect to the main portion of the wall 48 inside the fitting in such a manner that it is somewhat more inclined outwardly. Similar to the projection 43 of FIG. 7 or the projection 43' of FIG. 9, the tongue 49 has the function of guiding and centering containers stacked upon each other.

An opening 50 is provided in the reinforcing wall 48 which cooperates with the oblong hole 20 provided in the upper surface of the fitting for engagement of a crane hook.

Instead of the reinforcing wall 48 shown in FIG. 10, the corner fittings may be reinforced by an internal latticework formed of beams or rings which may result in a saving of weight while providing the same or even an increased rigidity than the reinforcing wall 48.

The features described in the above embodiments may be combined in different manners. E.g., the corner fitting of FIG. 9 may be formed from a square blank or from a blank having the general shape of FIG. 4 rather than from a circular blank. In the corner fitting of FIG. 5, the two downwardly extending edges of the opening 37 may be circular or curved in any other manner, as is basically shown in FIG. 6. The reinforcing wall 48 may be provided also in a corner fitting formed from a blank as shown in FIG. 4, in which case the side edges of the reinforcing wall would be reduced in accordance with the rounded lateral walls of the corner fitting. Instead of the circular or oblong holes as shown, other hole shapes may be used as are adapted to the occurring crane, lashing, coupling or centering forces.

Figure 11:
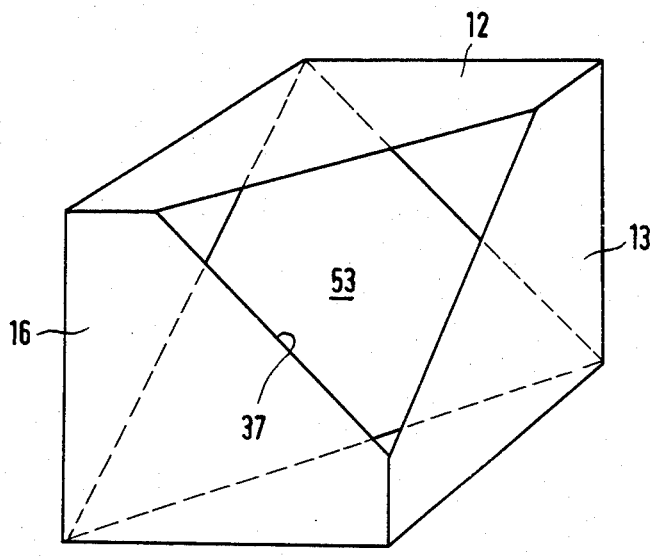
FIG. 11 is a perspective diagrammatic view for explaining the geometry of a further corner fitting.

The corner fitting shown in FIG. 11 consists of two lateral walls 13 and 16, an upper wall 12 and a junction plate 53 forming a rear wall. The walls 12, 13 and 16 together define a cube and form the three outer walls of the corner fitting. As above, the outer corner of this cube is omitted to form the triangular opening 37 extending obliquely with respect to the three walls. The three corners or tips of the junction plate 53 are connected to those corners of the three walls 12, 13 and 16 which are diagonally opposite to the omitted cube corner. Since the overall fitting is cubic and the opening 37 in the embodiment shown forms an equilateral triangle, the junction plate 53 is disposed in a space diagonal of the cube extending parallel to the plane of the opening 37.

Figure 14:
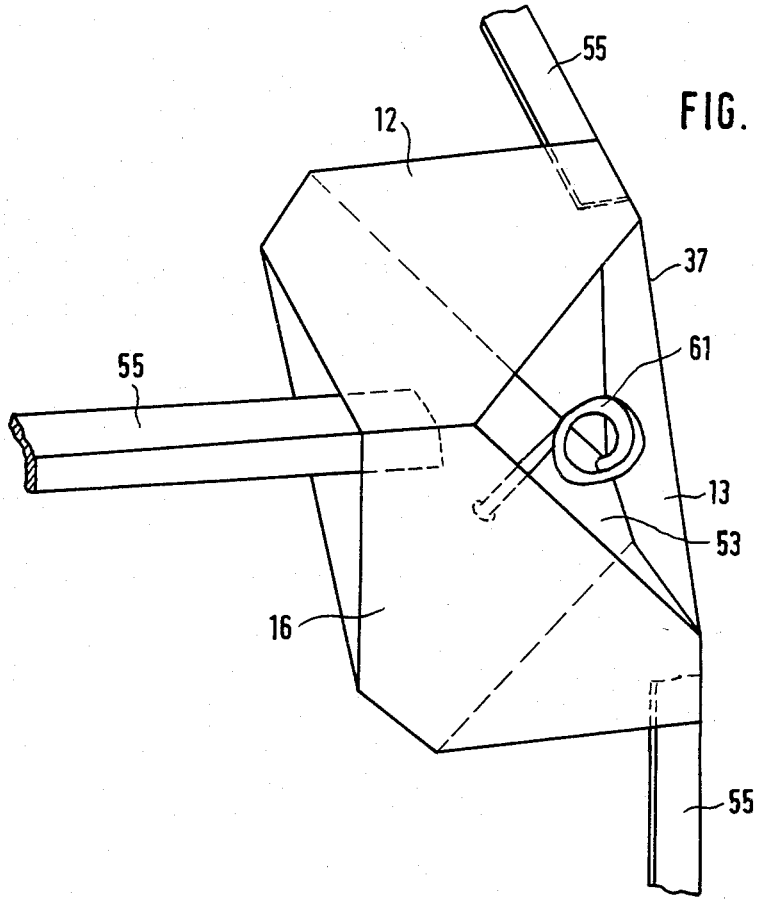
FIG. 14 is a perspective representation of the corner fitting of FIG. 11 in connection with container frame elements.

The walls 12 and 13 and the junction plate 53 expose a rearwardly triangular opening facing the container. Similar triangular openings are formed by the junction plate 53 with the two walls 13 and 16 and with the two walls 12 and 16. As shown in FIG. 14, frame elements of the container, which are shown in FIG. 14 as L-bars 55, may extend through these openings. By overlapping the ends of such L-bars 55 with the edge regions of the fitting, inaccuracies in the lengths of the L-bars may be compensated without affecting the overall outer dimensions of the container. The L-bars 55 may be welded to the corner fittings in an overlapping manner. According to FIG. 12, the fitting may be formed from one continuous blank in which the three walls 12, 13 and 16 are continuous along two of the cube edges retained outside the triangular opening 37. One tip of the triangular junction plate 53 is integrally formed at the outer edge of the blank portion forming the upper wall 12.

Figure 12:
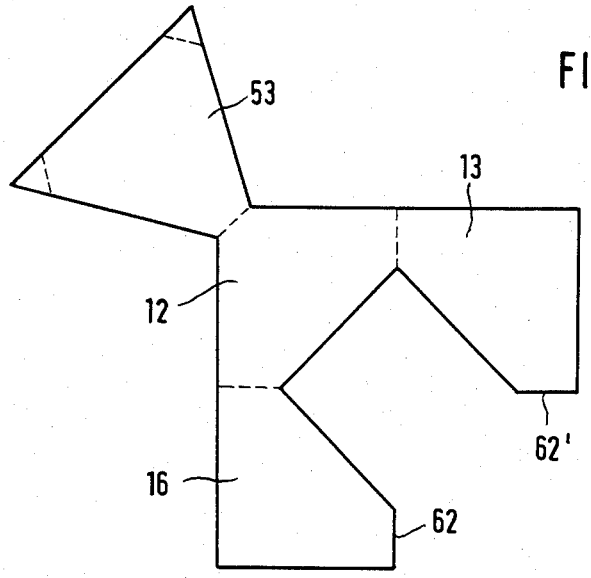
FIGS. 12 ad 13 are representations of blanks from which the corner fitting of FIG. 11 may be produced.

For forming the fitting, the blank shown in FIG. 12 is bent along the broken lines and the two free short edges 62, 62′ of the walls 13 and 16 are welded together to form the vertical front edge shown in FIG. 11. The two free tips of the junction plate 53 are also bent and welded to the corner region of the walls 12 and 13 at the inner sides thereof. The tip portions of the junction plate 53 may be bent inwardly or outwardly with respect to the corner fittings. In each case, the junction plate 53 does not exactly extend in the space diagonal plane of the cube shown in FIG. 11 but is offset from that plane closer to the container corner in the direction of the removed cube corner. Also in contrast to the diagrammatic representation of FIG. 11, the rear corner of the upper wall 12 extends obliquely due to the junction plate 53 being connected and bent at that location.

Figure 13:
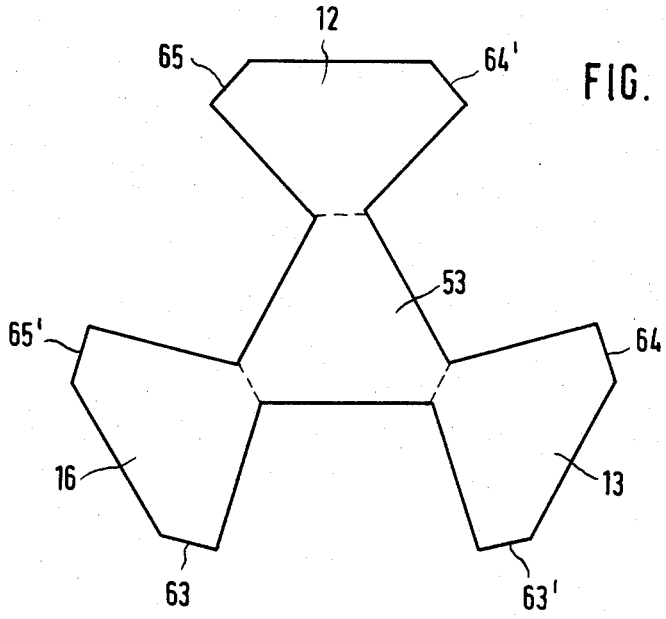

In the blank shown in FIG. 13, each of the three walls has its corner formed integrally to a tip of the junction plate 53. This blank is bent along the dotted lines, and the walls 12, 13 and 16 are welded together at their short free edges 63, 63′, 64, 64′, 65, 65′, with the edges 63, 63′ of the walls 13 and 16 forming the vertical front edge of FIG. 11, the edges 64, 64′ of the walls 12 and 13 forming the rearwardly extending upper cube edge, and the edges 65, 65′ of the walls 12 and 16 forming the upper edge extending to the left in FIG. 11. In this case, in contrast to the diagrammatic representation of FIG. 11, the three corners of the walls 12, 13 and 16 opposite to the omitted outer corner of the cube extend obliquely along the bending lines.

In a further modification, the corner fitting may be made from a blank which is similar to the blank shown in FIG. 12 but does not include the integrally formed junction plate 53. In this case, the junction plate may be formed without the tip shown in broken lines in FIGS. 12 and 13, thus be essentially hexagonal, in which case the corners of the walls 12, 13 and 16 are bent about the short edges of the hexagonal junction plate 53 and welded thereto. A corner fitting formed in this manner is diagrammatically shown in FIG. 14.

In the embodiment of FIGS. 15 and 16, the corner fitting is again manufactured from the three walls 12, 13 and 16 and a separately formed junction plate 53, a band-shaped bracket 56 being integrally formed to a tip of the plate 53. This bracket extends in that region, in which it is connected to the junction plate 53, parallel to the upper wall 12 of the corner fitting and is welded thereto. At the oblique corner of the upper wall 12 forming the triangular opening 37, the bracket is bent in an upwardly inclined direction to extend out of the corner fitting. This upwardly and outwardly inclined surface 57 of the bracket 56 forms an abutting and centering surface for the corresponding oblique edge of a lower corner fitting provided on a container to be stacked upon the present container. If all four corner fittings of the lower container are provided with brackets having inclined surfaces 57 as shown in FIGS. 15 and 16, an automatic centering of the upper container with respect to the lower one is achieved.

The inclined surface 57 of the bracket 56 ends outwardly in a curve and is fed back through the triangular opening 37 into the interior of the fitting. The free end 58 of the bracket 56 is welded to the junction plate 53 and is seen particularly clearly in FIG. 16. For reinforcing the junction plate 53 and the bracket 56, a reinforcing web 59 as shown in FIG. 16 may be inserted which extends in a vertical plane and is welded to the junction plate 53 as well as to both arms of the bracket 56.

As is shown in FIGS. 15 and 16, a ring 60 is fed through the bracket 56, which may be circular, semicircular or—as shown in FIG. 15—triangular in accordance with the shape of the opening 37. The ring 60 serves to receive a crane hook or other hoisting or pulling elements. In the operating condition, the ring 60 is in the bend of the bracket 56 projecting from the fitting, and this bend is selected such that the ring may freely pivot. In the inoperative condition, on the other hand, the ring 60 may slip into the interior of the fitting through the triangular opening 37, provided the outer dimensions of the ring are smaller than the opening 37.

As indicated in FIG. 14, a rigid hook 61 having an open helical eye may be fixed to the junction plate 53 instead of the bracket 56 of FIGS. 15 and 16, which hook 61 does not project from the cubic profile of the corner fitting and serves for engagement by a ring, crane hook, cable or rope loop. The eye of the hook 61 may be open as shown in FIG. 14, or may have its two ends welded to the junction plate 53.

It has been assumed in the drawings, that the junction plate 53 consists of a plane sheet of metal. Alternatively, it may be curved, a curving towards the outer corner of the fitting being advantageous in consideration of the space available for the container proper, and a curvature in the other direction being of advantage, e.g. in case a hook 61 for withstanding substantial pulling forces is connected to the junction plate 53 as shown in FIG. 14.

I claim:

1. Corner fitting for freight containers comprising:
three mutually perpendicular side walls connected to one another to form a section of a corner of a cube having its apex pointing outwardly from a freight container when in an in use position,
and an oblique triangular surface extending tranversely to a diagonal through the corner apex and joining the three side walls,
said triangular surface and at least one of said side walls including openings for container handling elements.

2. Corner fitting according to claim 1, wherein the three mutually perpendicular side walls are equal in length and wherein the oblique triangular surface is dimensioned so that between one quarter to one half of the full length of the respective walls remains on the side intersecting the respective corners of the triangular surface.

3. Corner fitting according to claim 1, wherein the oblique triangular surface is dimensioned so that one third of the full length of the respective walls remains on the side intersecting the respective corners of the triangular surface.

4. Corner fitting according to claim 1, wherein said triangular surface includes a reinforcing triangular shaped wall connected to the side walls.

5. The fitting of claim 1, wherein the opening provided in the triangular surface has the shape of a circle inscribed in the triangle.

6. The fitting of claim 1, wherein the opening provided in the triangular surface has the shape of a hexagon leaving only the three corner regions of the triangle.

7. The corner fitting of claim 1, wherein the triangular surface includes three bores adjacent the centers of the three sides of the triangle.

8. The fitting of claim 1, wherein one of said side walls includes an oblong hole having a longitudinal axis extending perpendicularly to the line of intersection between this wall and the triangular surface.

9. The fitting of claim 1, wherein a bore is provided in each side wall.

10. The fitting of claim 1, wherein an edge formed between one of said side walls and the triangular surface is reinforced.

11. The fitting of claim 10, including an inclined fin extending from the edge formed between one of the side walls and the triangular surface.

12. The fitting of claim 1, wherein a bracket is attached to the edge formed between one of the side walls and the triangular surface.

13. The fitting of claim 12, wherein the bracket extends in a plane perpendicular to said one of the side walls.

14. The fitting of claim 12, wherein the bracket extends in a plane parallel to one of the side walls.

15. The fitting of claim 1, including a Y-shaped bracket having its three ends connected to the corners of the triangular surface and being disposed within an omitted pyramidal portion of the fitting defined by the extension of the planes of the side walls beyond the triangular surface.

16. The fitting of claim 1, wherein said side walls are formed from a blank of sheet metal bent and welded at the edges of the fitting.

17. The fitting of claim 14, wherein triangular portions of the blank corresponding to an omitted pyramidal corner region defined by the extension of the planes of the side walls beyond the triangular surface are welded upon each other in an overlapping manner to form a reinforced triangular surface.

18. The fitting of claim 16, wherein the triangular portions of the blank corresponding to the pyramidal corner region are folded inwardly and welded to the outer side walls of the fitting in an overlapping manner to reinforce these side walls.

19. The fitting of claim 18, wherein a bore is disposed in the reinforced portion of the side wall.

20. The fitting of claim 17, including an inclined fin extending from the edge formed between one of the side walls and the triangular surface, wherein the fin is formed by one of the three triangular portions of the blank corresponding to the pyramidal corner region.

21. The fitting of claim 1, wherein said side walls are formed from a plane blank which is rectangularly bent along a first substantially straight line and is also rectangularly bent along a second straight line perpendicularly intersecting the first line, on one half of the second line from the intersection with the first line, and cut in the other half of the second line, the two quarters separated by the cut being interconnected in superimposed relationship in the final fitting.

22. The fitting of claim 21, wherein the blank has the shape of a circle centered at the intersection between the first and second lines.

23. The fitting of claim 21, wherein the blank consists of a semicircular segment of a radius r and a rectangle connected with its longer side to the basis of the segment along said first line, the rectangle having a side ratio of 2r:r.

24. The fitting of claim 21, wherein the opening is formed by a circular cut-out centered at the intersection between said first and second lines.

25. The fitting of claim 21, wherein the opening is formed by a cut in the form of a semicircle which is centered at the intersection between said first and second lines, which extends symmetrically with respect to said second line and intersects the cut half of said second line, a hole being disposed symmetrically to said second line in the bent portion thereof.

26. The fitting of claim 25, wherein the web formed between the semicircle and the hole is cut along said second line, the two web portions thus formed being connected in an overlapping manner.

27. The fitting of claim 21, wherein an opening is formed by a diamond-shaped cut-out, the two axes of the diamond coinciding with said first and second lines.

28. The fitting of claim 27, wherein the corners of said diamond-shaped cut-out are rounded.

29. The fitting of claim 21, wherein an opening is formed by two straight cuts extending from a point located on the cut half of said second line towards both sides thereof at the same angle to said first line, a hole being disposed symmetrically to said second line in the bent portion thereof.

30. The fitting of claim 21, wherein an opening is reinforced by a ring welded to the border of the opening or by a bead formed at the border of the opening.

31. The fitting of claim 21, including a reinforcing wall in the form of an equal-sided triangle having an opening, the reinforcing wall being inserted in the fitting in such a manner that its base coincides with a plane diagonal of the cubic fitting and its corner region opposite said base extends obliquely outwardly from the opening, the lateral edges of the reinforcing wall being welded to the internal walls of the fitting.

32. The fitting of claim 31, wherein the opening in said triangular surface of the fitting is triangular and has one of its edges welded to said reinforcing wall.

33. The fitting of claim 31, wherein the outwardly extending corner region of said reinforcing wall is bent outwardly.

34. The fitting of claim 21, including a lattice work welded to the interior of the fitting.

35. The fitting of claim 31, including an engagement element attached to said reinforcing wall and accessable from the outside.

36. The fitting of claim 1, wherein said three side walls have their corners diagonally opposite to an omitted pyramid bounded by the triangular surface interconnected by a substantially triangular junction plate extending substantially parallel to said triangular surface.

37. The fitting of claim 36, wherein the tips of said junction plate are bent and welded in an overlapping manner to the corner regions of said three walls.

38. The fitting of claim 36, wherein the tips of the junction plate are cut-off and the thus formed hexagonal junction plate is welded in an overlapping manner to the bent corner portions of said walls.

39. The fitting of claim 36, including an engagement element for receiving a hoisting or connecting means mounted on the inner surface of the junction plate facing the triangular opening.

40. The fitting of claim 37, wherein said engagement element consists of a bracket having one of its ends formed integrally to a tip of the junction plate and its other end welded to the inner surface of the junction plate.

41. The fitting of claim 40, wherein said bracket projects through said opening provided in said triangular surface to form an abutment surface extended obliquely outwardly with respect to one of said sidewalls of the fitting.

42. The fitting of claim 40, including a ring engaging said bracket, said ring being shaped so as to fit through the opening provided in said triangular surface.

43. The fitting of claim 40, including a reinforcing web inserted between the junction plate and the two arms of said bracket.

44. The fitting of claim 39, wherein said engagement element consists of a hook having a helical eye.

45. The fitting of claim 36, wherein said side walls are formed from a blank in which the corner regions of said three walls are formed integrally with said junction plate and are welded together at their edges forming the outer edges of the corner fitting.

46. The fitting of claim 45, wherein said three walls are interconnected by two bands forming two outer edges of the corner fitting and by a weld disposed in the third outer edge of the fitting, one tip region of the junction plate being formed integrally to one of said walls and having its other two tip regions welded to the remaining two walls.

47. The fitting of claim 45, wherein said junction plate is curved.

48. The fitting of claim 45, wherein the areas defined between the junction plate and the walls defining the corner fitting are left free for inserting container frame elements into the fitting and welding such elements in an overlapping manner to the edge regions of the fitting.

49. The fitting of claim 48, wherein said container frame elements are welded to the edges of said junction plate.

* * * * *